US008387603B2

(12) United States Patent
Darlington

(10) Patent No.: US 8,387,603 B2
(45) Date of Patent: Mar. 5, 2013

(54) COMPOUND ARCHERY BOW WITH INTERMEDIATE CABLE PULLEYS

(76) Inventor: Rex F. Darlington, Whittemore, MI (US)

( * ) Notice: Subject to any disclaimer, the term of this patent is extended or adjusted under 35 U.S.C. 154(b) by 504 days.

(21) Appl. No.: 12/660,655

(22) Filed: Mar. 2, 2010

(65) Prior Publication Data

US 2010/0154762 A1 Jun. 24, 2010

Related U.S. Application Data

(60) Provisional application No. 61/212,583, filed on Apr. 13, 2009.

(51) Int. Cl.
*F41B 5/10* (2006.01)
*F41B 5/00* (2006.01)
*F41B 5/12* (2006.01)

(52) U.S. Cl. ..... 124/25.6; 124/23.1; 124/25; 124/86; 124/88

(58) Field of Classification Search ..... 124/23.1, 124/25, 25.6, 86, 88
See application file for complete search history.

(56) References Cited

U.S. PATENT DOCUMENTS 3,854,467 A * 12/1974 Hofmeister ..... 124/25.6
3,967,609 A * 7/1976 Frydenlund ..... 124/25.6
3,987,777 A * 10/1976 Darlington ..... 124/25.6
4,077,385 A * 3/1978 Fredrickson ..... 124/25.6
4,261,320 A * 4/1981 Barna ..... 124/25.6
4,461,267 A * 7/1984 Simonds et al. ..... 124/25.6
4,562,824 A * 1/1986 Jennings ..... 124/25.6
4,672,943 A * 6/1987 Bozek ..... 124/25.6
4,683,865 A * 8/1987 Troncoso ..... 124/25.6
4,917,070 A * 4/1990 Townsend ..... 124/23.1
4,971,020 A * 11/1990 Soderstrom et al. ..... 124/23.1
5,054,463 A * 10/1991 Colley et al. ..... 124/25.6
5,535,727 A * 7/1996 Helmuth ..... 124/25.6
5,722,385 A * 3/1998 Bunk ..... 124/86
6,076,512 A * 6/2000 Thielen et al. ..... 124/25.6
6,098,607 A * 8/2000 Strother ..... 124/25.6
6,722,354 B1 * 4/2004 Land ..... 124/25.6
6,776,148 B1 * 8/2004 Islas ..... 124/25.6
7,047,958 B1 * 5/2006 Colley ..... 124/25.6
7,637,256 B2 * 12/2009 Lee ..... 124/25.6
7,823,572 B2 * 11/2010 Anderson ..... 124/25

* cited by examiner

*Primary Examiner* — Alvin Hunter
*Assistant Examiner* — Alexander Niconovich
(74) *Attorney, Agent, or Firm* — Reising Ethington PC

(57) ABSTRACT

A compound archery bow includes a bow handle having projecting limbs, and first and second pulleys mounted on the respective limbs for rotation around respective axes. A bow cable system includes a bowstring cable extending between the pulleys, and first and second power cables extending from the respective first and second pulleys toward the opposing pulley. Third and fourth pulleys are mounted on the handle. The third and fourth pulleys are engaged by the power cables and are at least partially offset from the bowstring cable so that the third and fourth pulleys hold the first and second power cables away from the bowstring cable, and the bowstring cable and an arrow engaged by the bowstring cable are unobstructed by the first and second power cables.

16 Claims, 4 Drawing Sheets

COMPOUND ARCHERY BOW WITH INTERMEDIATE CABLE PULLEYS

This application claims priority from U.S. application 61/212,583 filed Apr. 13, 2009, the disclosure of which is incorporated herein by reference.

The present disclosure relates to compound archery bows having pulleys at the ends of the bow limbs to control the force/draw characteristics of the bow, and more particularly to a bow having intermediate pulleys for engaging power cables extending from the end pulleys and holding the power cables away from the path of travel of the bowstring cable and an arrow engaged by the bowstring cable.

BACKGROUND AND SUMMARY OF THE DISCLOSURE

In dual-cam compound archery bows, power cams are mounted on the ends of the bow limbs. A bowstring cable extends between the cams for engagement with an arrow. A power cable extends from each cam toward the opposing cam to control rotation of the cams as the bowstring cable is drawn. A general object of the present disclosure is to provide a compound archery bow of this type that places reduced twist forces or torque on the bow limbs as the bowstring cable is drawn and/or that eliminates the need for a cable guard or other method to obtain clearance for the bowstring cable, arrow and fletching.

The present disclosure embodies a number of aspects that can be implemented separately from or in combination with each other.

A compound archery bow in accordance with one aspect of the present disclosure includes a bow handle having projecting limbs, and first and second pulleys mounted on the respective limbs for rotation around respective axes. A bow cable system includes a bowstring cable extending between the pulleys, and first and second power cables extending from the respective first and second pulleys toward the opposing pulley. Third and fourth pulleys are mounted on the handle. The third and fourth pulleys are engaged by the power cables and are at least partially offset from the bowstring cable so that the third and fourth pulleys hold the first and second power cables away from the plane of the bowstring cable, and the bowstring cable and an arrow engaged by the bowstring cable are unobstructed by the first and second power cables.

BRIEF DESCRIPTION OF THE DRAWINGS

The disclosure, together with additional objects, feature, advantage and aspects thereof, will best be understood from the following description, the appended claims and the accompanying drawings, in which:

DETAILED DESCRIPTION OF PREFERRED EMBODIMENTS

Figure 1:
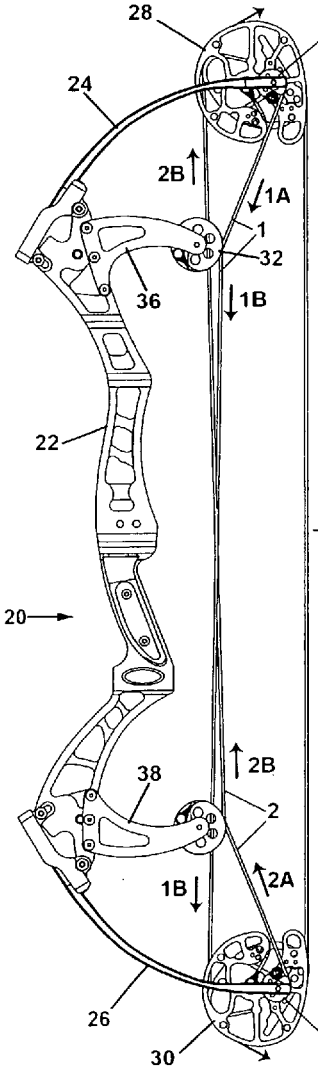
FIG. 1 is a side elevational view of a compound archery bow in accordance with a first exemplary embodiment of the disclosure.
Figure 2:
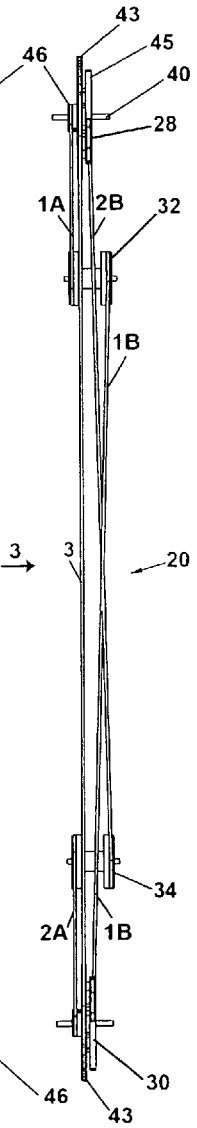
FIG. 2 is an end elevational view of the bow in FIG. 1.
Figure 1A:
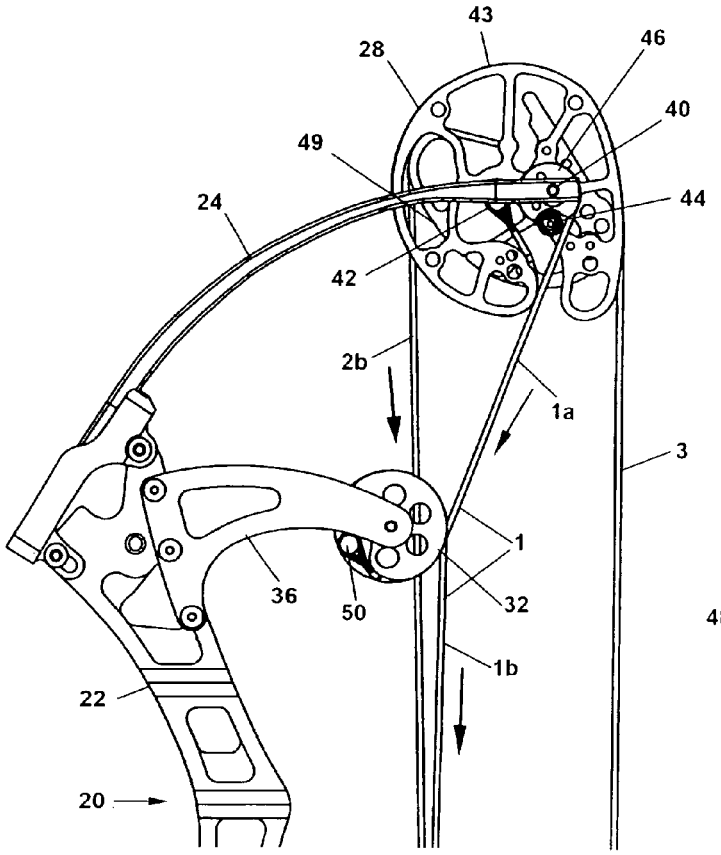
FIG. 1A is a fragmentary view on an enlarged scale of the upper portion of the bow in FIG. 1.
Figure 2A:
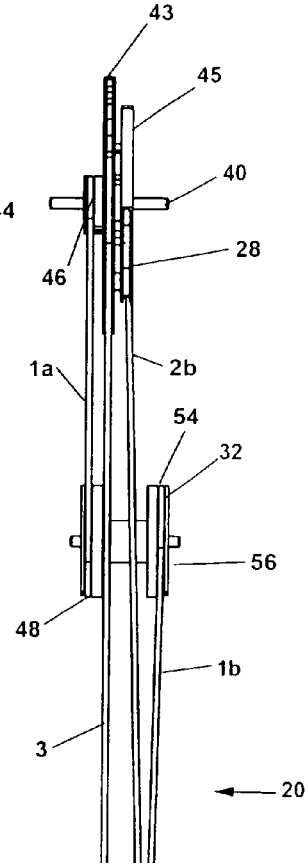
FIG. 2A is a fragmentary elevational view of the upper portion of the bow in FIG. 2.

FIGS. 1-2A illustrate a dual-cam compound archery bow 20 in accordance with one exemplary embodiment of the present disclosure. A handle 22 of aluminum or other relatively rigid construction preferably has spaced risers with limb-mounting surfaces at each end. A pair of flexible resilient limbs 24, 26 of fiber-reinforced resin or other suitable resilient construction are mounted on the respective handle risers and project away from handle 22. An upper pulley 28 is mounted on an end of limb 24 for rotation around an axle 40 (FIG. 1A). A lower pulley 30 is mounted on the end of lower limb 26 for rotation around an associated axle. Bow 20 is a dual-cam bow in which pulleys 28, 30 are similar in function and preferably nearer mirror images of each other. (One of the pulleys may be slightly larger than the other to compensate for the handle arrow rest not being at the true center of the bow. Some pulleys also can be made non-identical in areas that are non-functional to create a desired difference in appearance.) The pulleys 28, 30 illustrated in FIGS. 1-2A (and in FIGS. 3-13) are exemplary only.

A third pulley 32 is mounted by a bracket 36 on handle 22, preferably adjacent to limb 24, for free rotation around a third axis, which preferably is parallel to the axes of rotation of pulleys 28, 30. A fourth pulley 34 is mounted by a bracket 38 on handle 22, preferably adjacent to limb 26, for free rotation around a fourth axis that preferably is parallel to the axes of pulleys 32, 28 and 30. Each pulley 32, 34 has a pair of laterally spaced tracks or grooves 48, 54 (FIG. 2A). Pulleys 32, 34 preferably are H-shaped as viewed endwise of the bow (FIGS. 2 and 2A), providing a gap between grooves 48, 54 for passage of a bowstring power cable, as will be described. Pulleys 32, 34 may be of one-piece or multi-piece construction, such as of plastic or metal construction. Cable grooves 48, 54 preferably are circular around the axis of the pulley and of equal diameters. However, grooves 48, 54 could be non-circular and/or of non-identical shape, such as to enhance the action of the cams for example, but this would make the bow more difficult to time and is not preferred. Grooves 54 preferably are coplanar with each other. Grooves 48 likewise preferably are coplanar with each other. (All references to elements being "aligned" or "coplanar" or the like mean within manufacturing and assembly tolerances.) Pulleys 32, 34 preferably are mirror images of each other across the bow handle.

A bowstring cable 3 extends from an anchor 42 (FIG. 1A) at pulley 28 through a let-out track or groove 43 around the periphery of pulley 28, across handle 22, and then at pulley 30 through a peripheral let-out track or groove 43 to an anchor 42. A first power cable 1 extends from pulley 28 toward pulley 30. In the embodiment illustrated in FIGS. 1-2A, first power cable 1 includes a first section 1*a* extending from an anchor 44 around a cable let-out track or groove 46 through take-up track or groove 48 to an anchor 50 on pulley 32. A second section 1*b* of power cable 1 extends from an anchor 56 (FIG. 3A) through let-out groove 54 on pulley 32 toward lower pulley 30, at which power cable section 1*b* extends through a take-up track or groove 49 to an anchor 47 (FIG. 3A). In the same way, a power cable 2 includes a first section 2*a* extending, in this embodiment, from a let-out groove 46 at pulley 30 through take-up groove 48 at pulley 34 to an anchor 42. A second power cable section 2*b* extends from an anchor 56 at pulley 34 toward pulley 28, preferably through a take-up groove 49 on pulley 28 to an anchor 47. Power cable let-out grooves 46 preferably are circular and concentric with the axes of pulleys 28,30, but could be non-circular and/or non-concentric.

As best seen in FIGS. 2 and 2A, take-up grooves 48 of pulleys 32, 34 are disposed on one side of the plane of bowstring cable 3 and bowstring let-out grooves 43, while power cable sections 1*b*, 2*b* are held by let-out pulley grooves 54 on the opposing side of the bowstring plane. The particular embodiment illustrated in FIGS. 1-2A is for a right-handed archer, in which pulley cables sections 1*b*, 2*b* are disposed on the right side of the plane of bowstring cable 3 (as viewed from the rear in FIGS. 2 and 2A) and are held by pulleys 32, 34 away from the path of travel of bowstring cable 3 and the fletching of any arrow engaged with bowstring cable 3. The spaced sections of pulley 32, on which grooves 48, 54 are disposed, accommodate passage of power cable section 2*b* toward upper pulley 28. In the same way, the spaced sections of pulley 34 accommodate passage of power cable section 1*b* toward pulley 30.

The directional arrows in FIGS. 1 and 1A illustrate the direction of rotation of pulleys 28, 30 and the direction of movement of cables 1, 2, 3 as bowstring cable 3 is drawn away from handle 22. As bowstring cable 3 is drawn, bowstring cable lets out of bowstring cable let-out grooves 43 on pulleys 28, 30, rotating the pulleys in opposite directions around their respective axes. Power cable sections 1*a*, 2*a* are let out from grooves 46, and power cable sections 1*b*, 2*b* are taken up into grooves 49. Such take-up of power cable sections 1*b*, 2*b* rotate intermediate pulleys 32, 34 around their respective axes. Pulley 32 rotates clockwise as viewed in FIGS. 1 and 1A, and pulley 34 rotates counterclockwise. When bowstring 3 is released, the resiliency of limbs 24, 26 moves all cables in directions opposite to those described.

Figure 3:
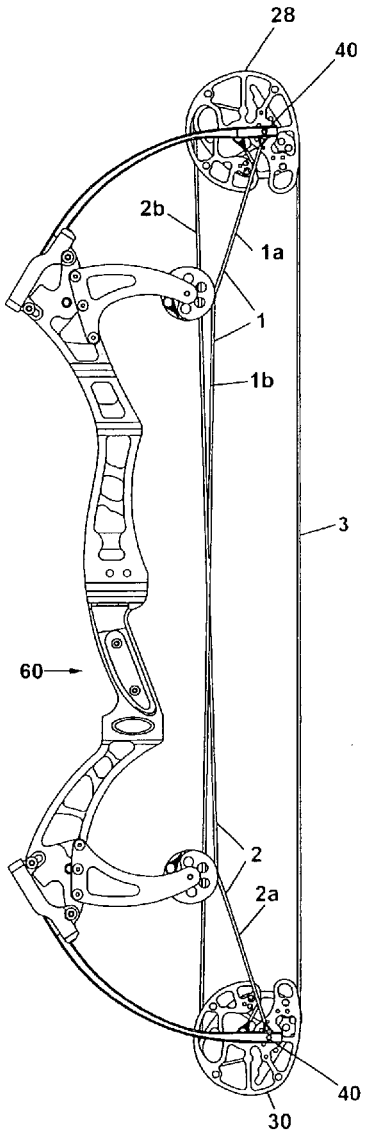
FIG. 3 is a side elevational view similar to that of FIG. 1 but showing a bow in accordance with a second exemplary embodiment of the disclosure.
Figure 4:
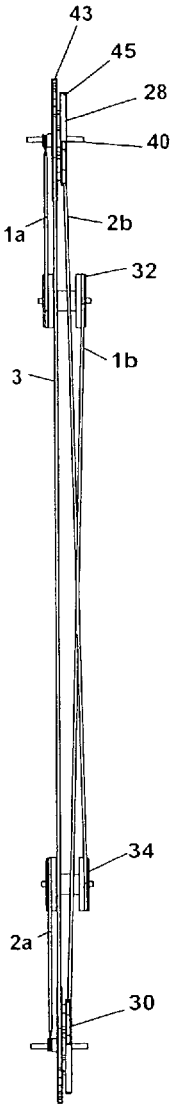
FIG. 4 is an end elevational view similar to that of FIG. 2 but showing the bow of FIG. 3.
Figure 3A:
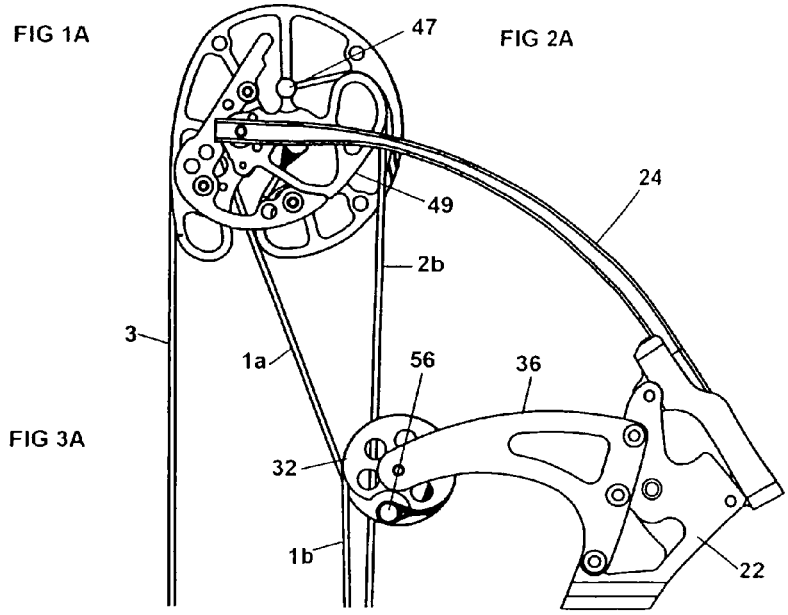
FIG. 3A is a fragmentary view of the opposing side of the bow as compared with FIG. 2A.

FIGS. 3-4 (and 5-13) illustrate additional exemplary embodiments of the disclosure, in which elements that are the same as or functionally similar to elements in bow 20 of FIGS. 1-2A are illustrated by correspondingly identical reference numerals.

FIGS. 3-4 illustrate a bow 60, in which the primary difference compared to bow 20 of FIGS. 1-2A is that power cable sections 1*a*, 2*a* are anchored at axles 40, rather than extending through cable let-out grooves 46 (FIGS. 1A and 2A) at the opposing pulleys.

Figure 5:
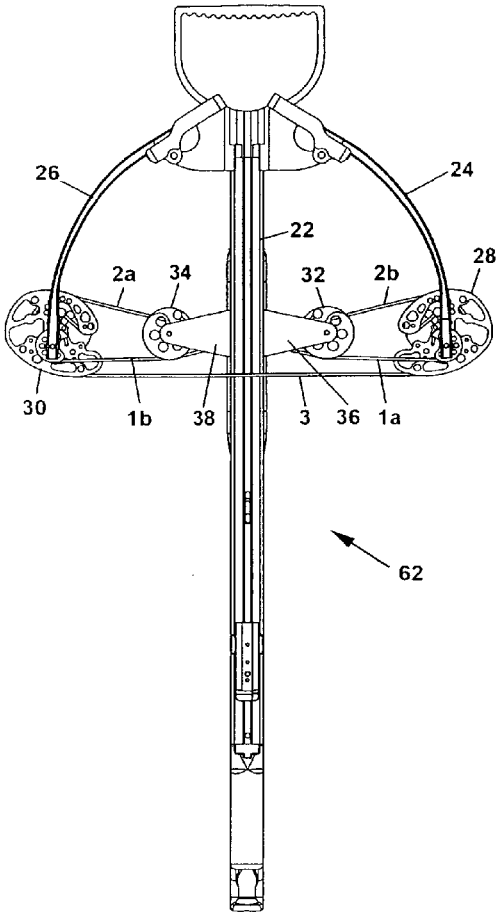
FIG. 5 is a top plan view of a crossbow in accordance with a third exemplary embodiment of the disclosure.
Figure 6:
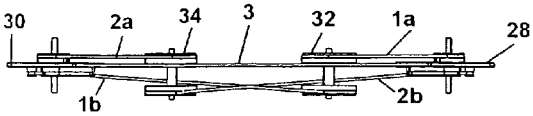
FIG. 6 is an end elevational view showing the bow cable system in the crossbow of FIG. 5.
Figure 7:
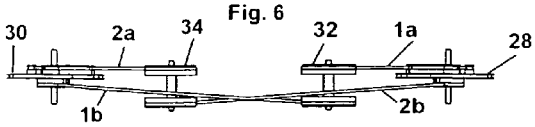
FIG. 7 is a view similar to that of FIG. 6 but with the bowstring cable deleted for clarity.

FIGS. 5-7 illustrate a crossbow 62 that includes pulleys 28, 30, a bowstring cable 1, and power cable sections 1*a*, 1*b* and 2*a*, 2*b* engaged with intermediate pulleys 32, 34 as previously described.

Figure 8:
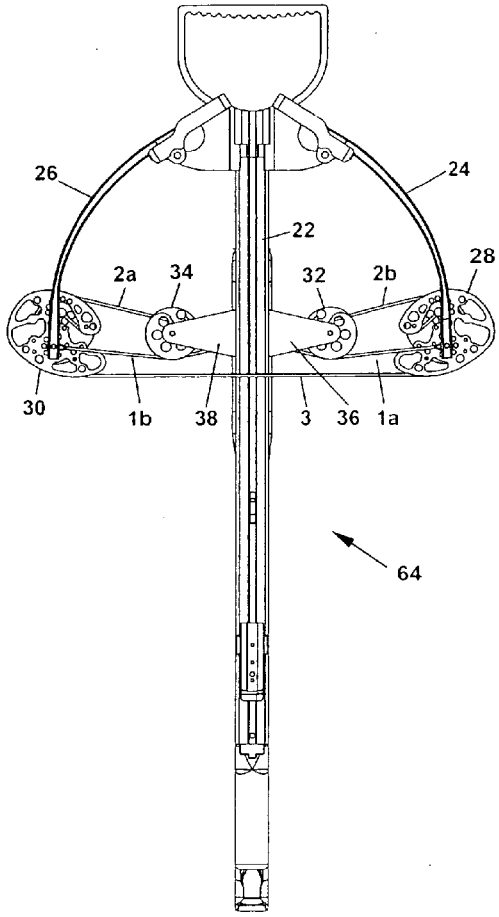
FIG. 8 is a top plan view of a crossbow in accordance with a fourth exemplary embodiment of the disclosure.
Figure 9:
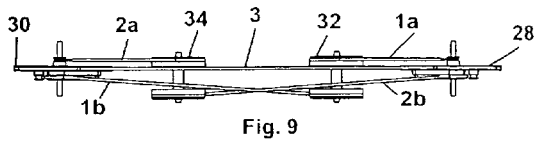
FIG. 9 is an end elevational view of the bow cable system in the crossbow of FIG. 8.

FIGS. 8-9 illustrate a crossbow 64 in which power cable sections 1*a*, 2*a* are anchored at axles 40 rather than extending through power cable let-out grooves at the respective pulleys as seen in FIGS. 5-7.

Figure 10:
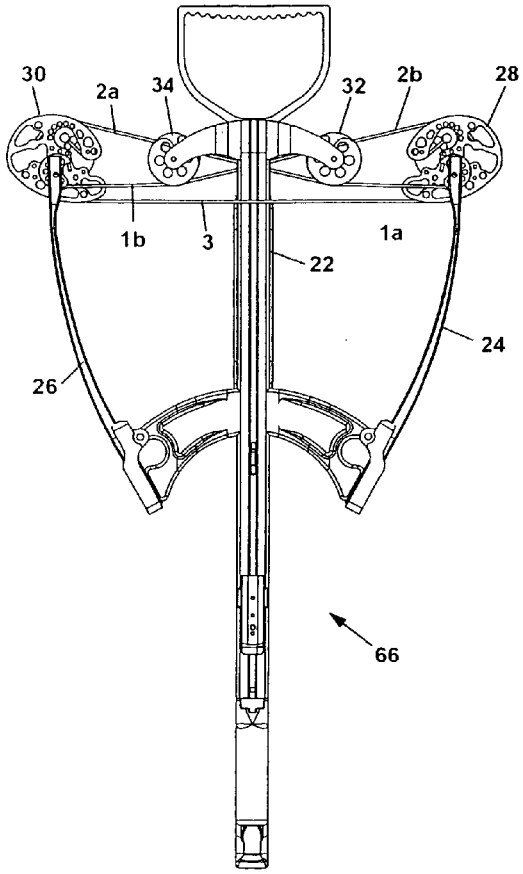
FIG. 10 is a top plan view of a crossbow in accordance with a fifth exemplary embodiment of the disclosure.
Figure 11:
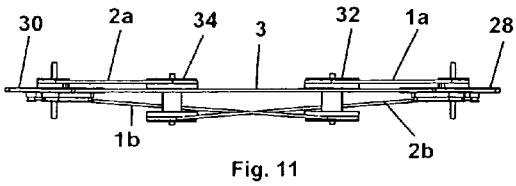
FIG. 11 is an end elevational view of the cable system in FIG. 10.

FIGS. 10-11 illustrate a crossbow 66 in which bow limbs 24, 26 extend forward rather than rearward. Crossbow 66 includes pulleys 28, 30, 32, 34 similar in structure and function to those illustrated in FIGS. 1-2A.

Figure 12:
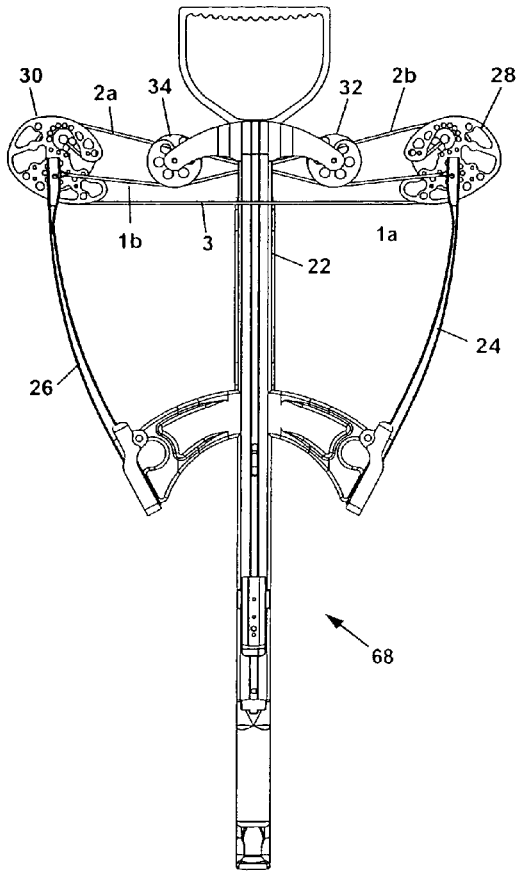
FIG. 12 is a top plan view of a crossbow in accordance with sixth exemplary embodiment of the disclosure.
Figure 13:
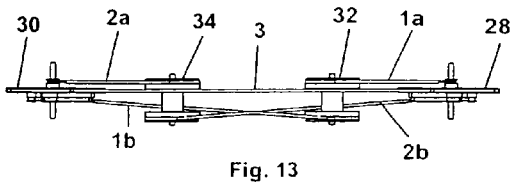
FIG. 13 is an end elevation view of the cable system in FIG. 12.

Likewise, FIGS. 12-13 illustrate a crossbow 68 with limbs 24, 26 extending in the forward direction, and with power cable sections 1*a*, 2*a* anchored at axles 40 rather than extending through let-out grooves at the opposing pulleys as seen in FIGS. 10-11.

The exemplary (but non-limiting) embodiments of the disclosure, in summary, present a compound archery bow 20 or 60 or 62 or 64 or 66 or 68 that includes a bow handle 22 having projecting limbs 24, 26. A first pulley 28 (or 30) is mounted on a first of the limbs for rotation around a first axis, for example the axis of axle 40. A second pulley 30 (or 28) is mounted on a second of the limbs for rotation around a second axis. A bow cable system includes a bowstring cable 3 extending from a first bowstring anchor 42 through a first bowstring let-out groove 43 on the first pulley across the handle to a second bowstring let-out groove 43 and a second bowstring anchor 42 on the second pulley. A first power cable extends from a first power cable anchor 44 (or 40) at the first pulley across the handle to a first power cable take-up groove 45 and a second power cable anchor on the second pulley. A second power cable extends from a third power cable anchor 44 (or 40) at the second pulley across the handle to a second power cable take-up groove and a fourth power cable anchor on the first pulley. Draw of the bowstring cable away from the handle lets put bowstring cable 3 from the first and second bowstring let-out grooves 43, rotates the first and second pulleys around their axes, and takes up first and second power cables into the first and second power cable take-up grooves on the pulleys.

The first and second bowstring let-out grooves 43 are aligned with each other across the handle and coplanar with each other in a bowstring plane. The first and second power cable take-up grooves 45 are disposed on one side of the bowstring plane. A third pulley 32 (or 34) is mounted on handle 22, preferably adjacent to limb 24 (or 26), for rotation around a third axis. The third pulley has a third take-up groove 48 on one side of the bowstring plane and a third let-out groove 54 on the opposing side of the bowstring plane, as best seen in FIGS. 2 and 2A. A fourth pulley 34 (or 32) is mounted on handle 22, preferably adjacent to the second limb 26 (or 24), for rotation around a fourth axis. The fourth pulley includes a fourth take-up groove 48 on one side of the bowstring plane and a fourth let-out groove 54 on the opposing side of the bowstring plane. The first power cable includes a first section 1*a* (or 2*a*) extending from the first power cable anchor 44 or 40 at the first pulley through the third take-up groove 48 on the third pulley to a first intermediate anchor 50, and a second section 1*b* (or 2*b*) extending from a second intermediate anchor 56 on the third pulley through the third let-out groove 54 on the third pulley to the second pulley. The second power cable includes a first section 2*a* (or 1*a*) extending from the second power cable anchor 44 or 40 on the second pulley through the fourth take-up groove 48 on the fourth pulley 34 (or 32) to a third intermediate anchor 50 on the fourth pulley, and a second section 2*b* (or 1*b*) from a fourth intermediate anchor 56 on the fourth pulley through the fourth let-out groove 54 on the fourth pulley to the first pulley. The let-out grooves 54 on the third and fourth pulleys 32, 34 preferably are coplanar in a plane offset from the bowstring plane. Take-up grooves 48 and let-out grooves 54 preferably are circular, and preferably are of equal diameters.

There thus has been disclosed a compound archery bow that fully satisfies all of the objects and aims previously set forth. The bow has been disclosed in conjunction with several exemplary embodiments, and additional modifications and variations have been discussed. Other modifications and variations readily will suggest themselves to persons of ordinary skill in the art in view of the foregoing description. The disclosure is intended to embrace all such modifications and variations as fall within the spirit and broad scope of the appended claims.

The invention claimed is:

1. A compound archery bow that includes:

a bow handle having projecting limbs, a first pulley mounted on a first of said limbs for rotation around a first axis, a second pulley mounted on a second of said limbs for rotation around a second axis, bow cable means including a bowstring cable extending from a first bowstring anchor through a first bowstring let-out groove on said first pulley across said handle to a second bowstring let-out groove and a second bowstring anchor on said second pulley, a first power cable extending from a first power cable anchor at said first pulley across said handle to a first power cable take-up groove and a second power cable anchor on said second pulley, a second power cable extending from a third power cable anchor at said second pulley across said handle to a second power cable take-up groove and a fourth power cable anchor on said first pulley, such that draw of said bowstring cable away from said handle lets out bowstring cable from said first and second bowstring let-out grooves, rotates said first and second pulleys around said axes, and takes up said first and second power cables into said first and second power cable take-up grooves on said pulleys, wherein said first and second bowstring let-out grooves are aligned across said handle and coplanar with each other in a bowstring plane, said first and second power cable take-up grooves are disposed on one side of said plane, a third pulley is mounted on said handle adjacent to said first limb for rotation around a third axis, said third pulley having a third take-up groove on one side of said plane and a third let-out groove on an opposing side of said plane, a fourth pulley is mounted on said handle adjacent to said second limb for rotation around a fourth axis, said fourth pulley having a fourth take-up groove on said one side of said plane and fourth let-out groove on said opposing side of said plane, said first power cable includes a first section extending from said first power cable anchor at said first pulley through said third take-up groove on said third pulley to a first intermediate anchor, and a second section extending from a second intermediate anchor on said third pulley through said third let-out groove on said third pulley to said second pulley, and said second power cable includes a first section extending from said second power cable anchor at said second pulley through said fourth take-up groove on said fourth pulley to a third intermediate anchor on said fourth pulley, and a second section extending from a fourth intermediate anchor on said fourth pulley through said fourth let-out groove on said fourth pulley to said first pulley.

2. The bow set forth in claim 1 wherein said let-out grooves on said third and fourth pulleys are coplanar in a plane offset from said bowstring plane.

3. The bow set forth in claim 2 wherein said third take-up groove and said third let-out groove on said third pulley are circular.

4. The bow set forth in claim 3 wherein said third grooves are of identical diameter or shape.

5. The bow set forth in claim 3 wherein said fourth take-up groove and said fourth let-out groove on said fourth pulley are circular.

6. The bow set forth in claim 5 wherein said circular fourth grooves are of equal diameter or shape.

7. The bow set forth in claim 2 wherein said fourth take-up groove and said fourth let-out groove on said fourth pulley are circular.

8. The bow set forth in claim 7 wherein said circular fourth grooves are of identical diameter or shape.

9. The bow set forth in claim 2 wherein said third grooves and said fourth grooves are all circular and of equal diameter.

10. The bow set forth in claim 1 wherein said first section of said first power cable extends at said first pulley through a first power cable let-out groove from said first anchor, and said first section of said second power cable extends at said second pulley through a second power cable let-out groove from said second anchor.

11. The bow set forth in claim 10 wherein said power cable let-out grooves are circular.

12. The bow set forth in claim 1 wherein said first sections of said first and second power cables are anchored at said first and second axes.

13. The bow set forth in claim 1 wherein said bow is a crossbow.

14. The bow set forth in claim 2 wherein said third take-up groove and said third let-out groove on said third pulley are non circular.

15. The bow set forth in claim 14 wherein said fourth take-up groove and said fourth let-out groove on said fourth pulley are non circular.

16. The bow set forth in claim 2 wherein said fourth take-up groove and said fourth let-out groove on said fourth pulley are non circular.

* * * * *